US005791950A

United States Patent [19]

Weronke et al.

[11] Patent Number: 5,791,950

[45] Date of Patent: Aug. 11, 1998

[54] TWIN PROPELLER MARINE PROPULSION UNIT

[75] Inventors: Robert B. Weronke, Oshkosh; Michael A. Karls, Hilbert; Roger E. Koepsel, Oshkosh; Donald F. Harry, Appleton, all of Wis.

[73] Assignee: Brunswick Corporation, Lake Forest, Ill.

[21] Appl. No.: 759,601

[22] Filed: Dec. 5, 1996

[51] Int. Cl.[6] ..... B63H 20/20

[52] U.S. Cl. ..... 440/75; 440/80

[58] Field of Search ..... 440/80, 81, 75; 416/128, 129

[56] References Cited

U.S. PATENT DOCUMENTS

| | | |
|---|---|---|
| 2,672,115 | 3/1954 | Conover . |
| 2,989,022 | 6/1961 | Lundquist . |
| 3,478,620 | 11/1969 | Shimanckas . |
| 4,793,773 | 12/1988 | Kinouchi et al. . |
| 4,871,334 | 10/1989 | McCormick . |
| 5,230,644 | 7/1993 | Meisenburg et al. . |
| 5,249,995 | 10/1993 | Meisenburg et al. . |
| 5,344,350 | 9/1994 | Hatch . |
| 5,352,141 | 10/1994 | Shields et al. . |
| 5,366,398 | 11/1994 | Meisenburg et al. . |
| 5,376,031 | 12/1994 | Meisenburg et al. . |
| 5,376,034 | 12/1994 | Meisenburg et al. . |
| 5,403,218 | 4/1995 | Onoue et al. . |
| 5,449,306 | 9/1995 | Nakayasu et al. . |
| 5,514,014 | 5/1996 | Ogino et al. . |
| 5,520,559 | 5/1996 | Nakayasu et al. . |
| 5,522,703 | 6/1996 | Okamoto . |
| 5,529,520 | 6/1996 | Iwashita et al. . |

FOREIGN PATENT DOCUMENTS

| | | | |
|---|---|---|---|
| 1-28093 | 1/1989 | Japan | 440/80 |
| 7-149293 | 6/1995 | Japan | 440/75 |

*Primary Examiner*—Sherman Basinger

*Attorney, Agent, or Firm*—Andrus, Sceales, Starke & Sawall

[57] ABSTRACT

An improved twin propeller marine propulsion unit. A vertical drive shaft is journaled in the lower gearcase and drives a pair of bevel gears. A pair of concentric propeller shafts are mounted in the lower torpedo section of the gearcase and each shaft carries a propeller. A slidable clutch is movable between a neutral, a forward, and a reverse position and serves to operably connect the outer propeller shaft with one of the bevel gears when the clutch is moved to the forward drive position. A gear is mounted for sliding movement in unison with the clutch and acts to operably engage the inner propeller shaft with the second bevel gear when the clutch is in the forward drive position so that both propellers are driven in opposite directions to provide forward motion for the watercraft. The propulsion unit also includes a dual cooling water pick-up system in which seawater is drawn to the water pump both through a series of vertical inlet ports in the gearcase and through a plurality of inlet holes that are located in the forward end of the lower torpedo section. Exhaust gas from the engine is discharged through the rear end of the lower housing section through axial passages in the hub of the forward propeller and then across the outer surface of the rear propeller.

10 Claims, 4 Drawing Sheets

FIG. 1
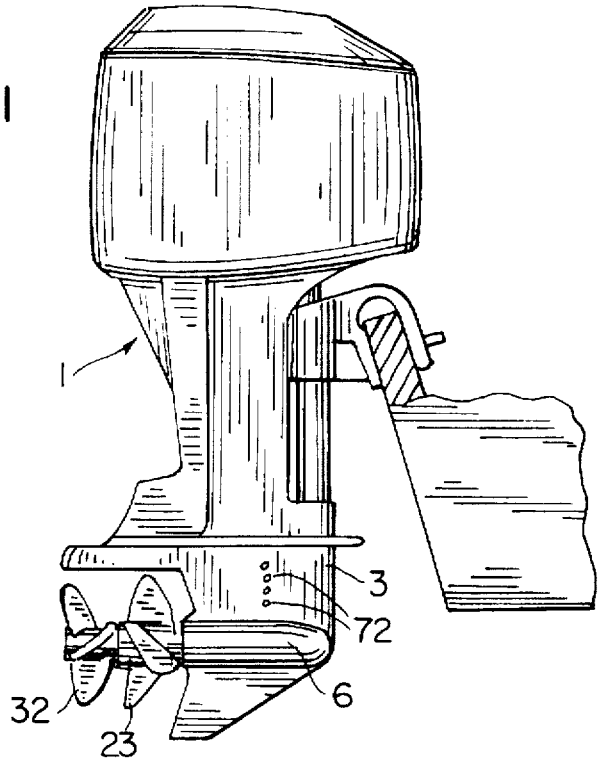
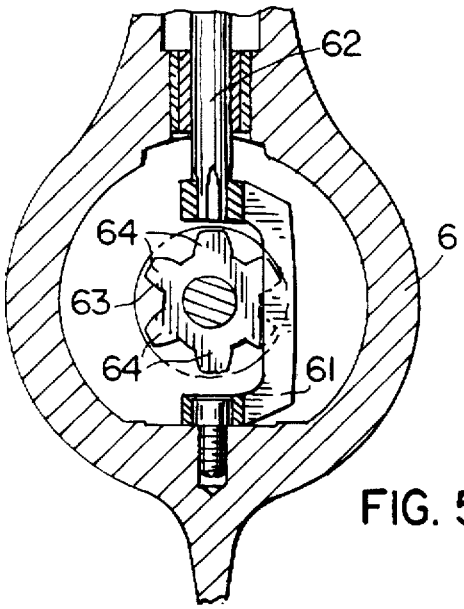
FIG. 5

73
2
3
5

78
72
4
15
13
5
12
14
10
31
30
17
52
18
49
54
52
77
30
31
32
33
34
53
55
6
7
8
9
5

15
14
16
13
50
49
5
54
55
62
10
3
12
18
17
65
66
59
90
67
60
59
58
35
61
56
57
64
63
53
52
67
68
69
36
6
7
8
9

TWIN PROPELLER MARINE PROPULSION UNIT

BACKGROUND OF THE INVENTION

Many marine propulsion units, such as outboard drives and inboard-outboard drives, utilize a forward-neutral-reverse transmission along with a twin propeller. The typical twin propeller system includes a vertical drive shaft which is operably connected to the engine and is journaled for rotation in the lower gearcase. The lower end of the drive shaft carries a beveled pinion which drives a pair of coaxial bevel gears. Mounted for rotation within the central openings of the bevel gears is an inner propeller shaft, the outer end of which carries a first propeller, while an outer propeller shaft is journaled around the inner shaft and carries the second propeller, which is located forwardly of the first propeller.

Incorporated with the typical twin propeller propulsion system is a sliding clutch mechanism having forward, neutral and reverse positions. When the clutch is moved to the forward drive position, the clutch mechanism will act to operably connect the propeller shafts to the respective bevel gears to thereby rotate both propellers in the opposite directions and move the watercraft forwardly. Movement of the clutch mechanism to the reverse drive position in the typical system, will operably engage only the inner propeller shaft with one of the bevel gears, while disengaging the outer propeller shaft, to thereby drive the watercraft in a reverse direction.

SUMMARY OF THE INVENTION

The invention is directed to an improved twin propeller marine propulsion unit which has a simplified construction over drive units as used in the past. In accordance with the invention, a vertical drive shaft is journaled for rotation in the lower gear-case or housing and carries a bevel pinion gear which drives a pair of coaxial bevel gears. Inner and outer coaxial propeller shafts are journaled for rotation within the lower torpedo-shaped section of the gearcase and both propeller shafts carry a propeller, with the propeller of the outer propeller shaft being located forwardly of the propeller on the inner propeller shaft.

A sliding clutch is mounted for movement in the lower section of the housing between a neutral position, a forward drive position and a reverse drive position. The clutch is splined to the outer propeller shaft and when the clutch is moved to the forward drive position, teeth on one end of the clutch will engage axial clutch teeth on one of the bevel gears, to thereby drive the outer propeller shaft.

In order to move the clutch between the neutral, forward and reverse positions, the clutch is connected to a slide that is mounted within an opening in the inner propeller shaft and the slide can be moved axially by a conventional actuating rod mechanism. The slide is connected to the clutch via a pin that extends through elongated longitudinal slots in the inner propeller shaft and is connected to the clutch in a manner such that the clutch will move with axial movement of the pin, but is free to rotate relative to the pin.

The forward end of the slide carries a gear and by moving the clutch to the forward drive position, the gear will engage internal gear teeth on the second bevel gear to thereby drive the inner propeller shaft. Thus, in the forward drive mode, both propeller shafts and propellers are driven at the same speed and in opposite directions.

By moving the slide in the opposite direction, the clutch will be moved to the reverse drive position in which teeth on the opposite end of the clutch will engage axial clutch teeth on the second bevel gear to thereby drive the outer propeller shaft and its propeller in the opposite direction. However, in this position, the teeth on the gear will be out of engagement with the internal gear teeth on the second bevel gear so that the inner propeller shaft and its propeller will not rotate during the reverse mode of operation.

The drive mechanism for the twin propeller marine propulsion unit is a simplified construction having fewer components than twin propeller drive mechanisms as used in the past. As a further advantage, the mechanism is easier to assemble and disassemble than prior drive constructions.

As a second feature of the invention, the propulsion unit includes a dual cooling water pick-up system. In this aspect of the invention, both sides of the gearcase include a series of vertically spaced water inlet ports that communicate with a generally arcuate water passage in the gearcase. The upper end of the arcuate water passage communicates with the inlet of a water pump that is driven by the vertical drive shaft. In addition, the water pick-up system includes a plurality of inlet holes that are located in the bullet-shaped forward end of the lower section of the gearcase beneath a horizontal plane extending through the axis of the lower section. The inlet holes communicate with a second water passage in the gearcase which also communicates with the inlet of the water pump. With this system, water for cooling is not only drawn to the pump through the series of vertical inlet ports in the gearcase, but also through the inlet holes in the forward end of the torpedo-shaped lower section. At slow boat speeds, this provides greater area for water pick-up which aids in supplying water to the pump. Further, the two pick-up systems ensure adequate water being supplied to the pump even though certain inlet pick-up holes may be clogged by weeds or the like.

The invention also includes a novel construction for the discharge of exhaust gas from the engine. The rear portion of the lower gearcase includes an exhaust chamber which receives exhaust gas from the engine and the exhaust gas is discharged from the chamber through an annular opening in the rear end of the lower torpedo section. A major portion of the exhaust gas is discharged from the annular opening in the lower section into a series of axial passages in the hub of the forward propeller. After passing through the axial passages in the hub of the forward propeller, the exhaust gas then flows across the outer surface of the rear propeller. Thus, with the construction of the invention, the exhaust gas is directed through the hub of the forward propeller and then across the outer surface of the rear propeller which provides improved performance for the engine.

Other objects and advantages will appear in the course of the following description.

DESCRIPTION OF THE DRAWINGS

The drawings illustrate the best mode of carrying out the invention.

In the drawings:

FIG. 1 is a side elevation of a typical outboard marine drive incorporating the invention;

FIG. 5 is a section taken along line 5—5 of FIG. 4;

DESCRIPTION OF THE ILLUSTRATED EMBODIMENT

FIG. 1 shows the invention as associated with an outboard drive marine engine 1. However, it can also be used with an inboard/outboard drive, in which the engine is located inboard of the boat.

Figure 2:
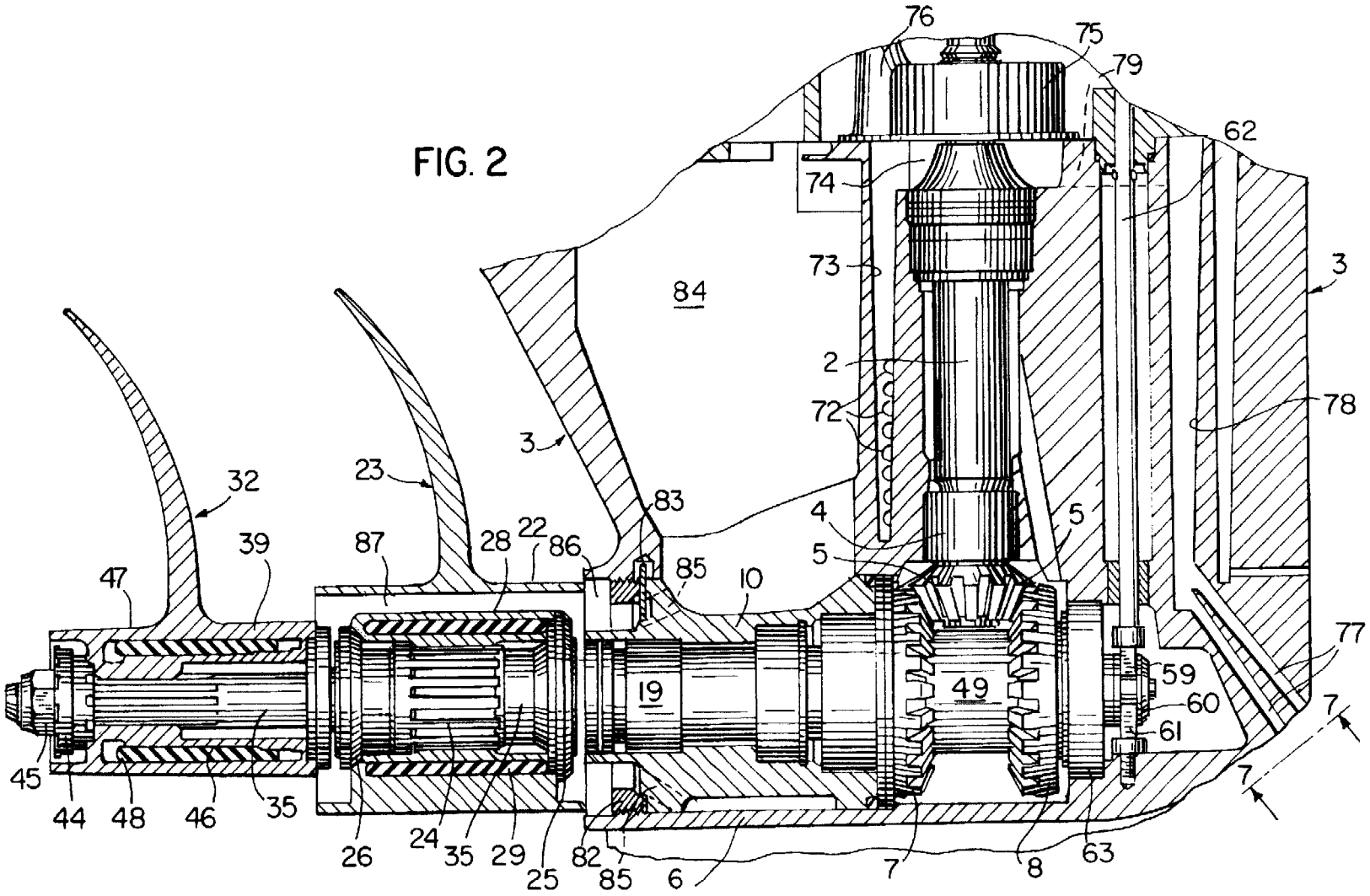
FIG. 2 is an enlarged fragmentary longitudinal section of the drive mechanism.
Figure 7:
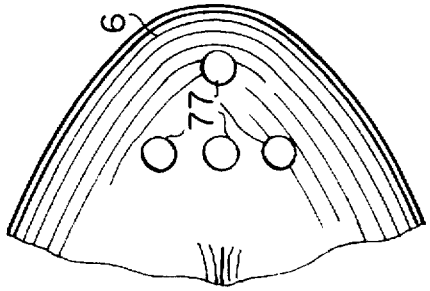
FIG. 7 is a view taken along line 7—7 of FIG. 2.

As best shown in FIG. 2, the drive mechanism includes a vertical drive shaft 2 which is journaled in gearcase 3 by bearing assembly 4. The lower end of drive shaft 2 carries a beveled pinion gear 5 which is located at the lower end of the gear case, slightly above the lower torpedo section 6 of the gearcase.

Figure 4:
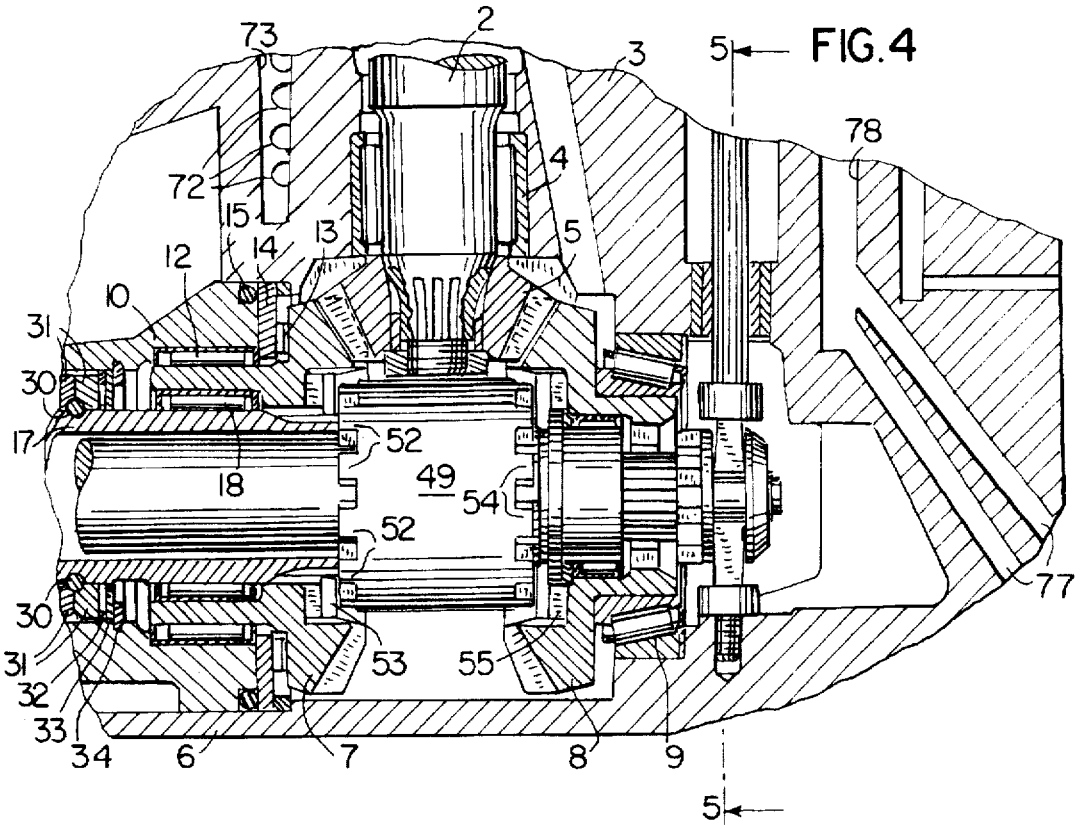
FIG. 4 is an enlarged fragmentary longitudinal section showing the bevel gear drive mechanism.
Figure 6:
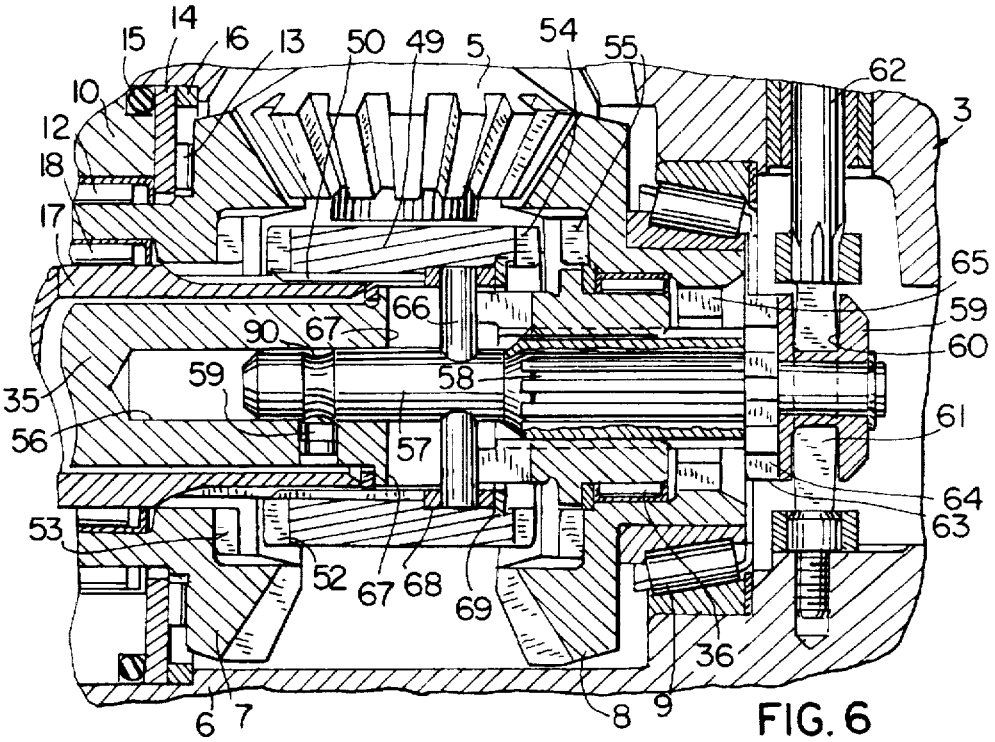
FIG. 6 is an enlarged longitudinal section showing the bevel gear drive and clutches.

Pinion gear 5 is engaged with a pair of annular bevel gears 7 and 8. Gear 8 is journaled for rotation relative to the torpedo section 6 of gearcase 3 by a bearing assembly 9, while the hub portion of gear 7 is journaled for rotation relative to a bearing carrier 10 by a radial bearing assembly 12, as seen in FIG. 4. In addition, a thrust bearing assembly 13 is located between bevel gear 7 and thrust washer 14 that bears against the forward end of the bearing carrier 10. An O-ring seal 15 is mounted within a recess in the forward end of bearing carrier 10 to seal the joint between the bearing carrier and gearcase 3, and an annular shim 16, as best seen in FIG. 6, is positioned between the outer edge of thrust washer 14 and an internal shoulder on gearcase 3.

Mounted for rotation within torpedo section 6 of gearcase 3 is an outer propeller shaft 17. Shaft 17 is journaled for rotation by a pair of bearing assemblies 18 and 19. Bearing assembly 18 is located between the hub portion of bevel gear 7 and the outer surface of shaft 17, while bearing assembly 17 is positioned between the outer surface of shaft 17 and the inner surface of bearing carrier 10. In addition, a pair of seals 20 are located in the clearance between the rear end of bearing carrier 10 and the outer surface of propeller shaft 17, as shown in FIG. 3.

Figure 3:
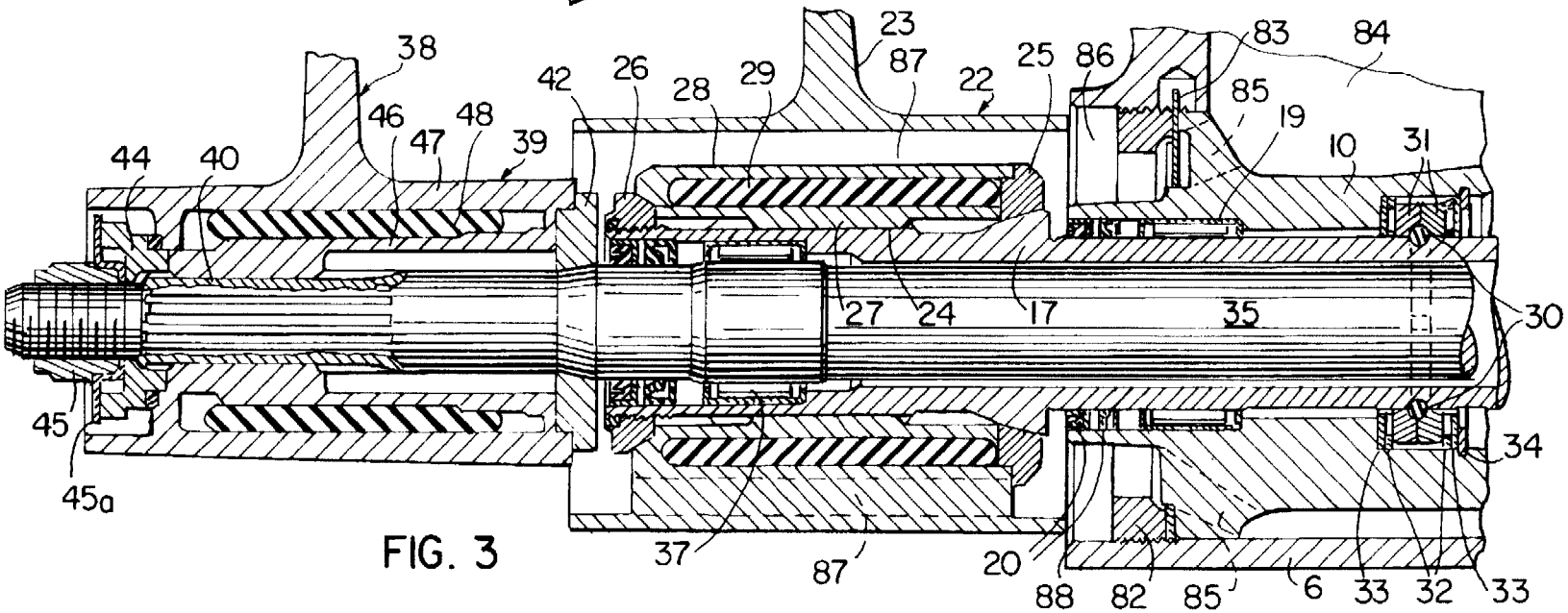
FIG. 3 is an enlarged fragmentary longitudinal section showing the attachment of the propellers to the inner and outer propeller shafts.

The hub 22 of propeller 23 is secured to the rear end of outer shaft 17 by spline 24, as shown in FIG. 3. Hub 22 is positioned axially on shaft 17 by a forward thrust hub 25 and a rear nut 26. Thrust hub 25 is provided with an internal inclined surface which engages a corresponding inclined outer surface on shaft 17, while nut 26 is threaded on the outer end of shaft 17 and engages the rear end of hub 22. Hub 22 includes an inner section 27 which is splined to the shaft and an annular section 28 which is spaced from the inner section and an annular rubber-like cushion 29 is located between the hub sections 27 and 28.

Located centrally of the length of propeller shaft 17 is a thrust ring which is composed of two semi-circular sections 30 that are mounted within a circumferential groove in the outer surface of shaft 17, as shown in FIG. 3. Washers 31 have mating internal recesses which receive the sections 30 and thrust bearings 32 and thrust washers 33 are located outwardly of each washer 31. The entire unit is maintained in position against an internal shoulder on bearing carrier 10 by snap ring 34. The semicircular ring sections 30 in effect provide a thrust ring which will accommodate the forward and rear thrust applied to the propeller shaft 17.

Mounted concentrically within outer propeller shaft 17 is an inner propeller shaft 35. Inner shaft 35 is journaled for rotation with respect to bevel gear 8 by a forward bearing assembly 36, while the rear end portion of shaft 35 is journaled within outer shaft 17 by a rear bearing assembly 37.

The rear end of inner shaft 35 carries a propeller 38 that is located to the rear of propeller 23. The hub 39 of propeller 38 is connected to shaft 35 through spline 40. The forward end of hub 39 bears against a forward thrust hub 42 having a tapered inner surface that bears against a corresponding tapered outer surface on shaft 35, while the rear end of hub 39 is engaged by a ring 44 which is contained on the end of shaft 36 by a nut 45 and a locking tab washer 45*a*. Propellers 23 and 38 have opposite hands, the front one being a left hand rotation and the rear one being a right hand rotation.

Hub 39 of propeller 38 is formed with an inner section 46 which is splined to inner shaft 35 and an outer section 47, which is spaced outwardly of inner section 46. An annular rubber-like insert or cushion 48 is located between the two sections 46 and 47, as shown in FIG. 3.

In accordance with a feature of the invention, an annular clutch 49 is positioned around the shafts 17 and 35 and is connected for sliding movement relative to outer shaft 17 by spline 50. Thus, clutch 49 can be moved longitudinally relative to shaft 17, but the clutch and outer shaft will rotate together. Clutch 49 is provided with a plurality of circumferentially spaced teeth 52 that face to the rear and are adapted to engage axial facing clutch teeth 53 on bevel gear 7. In addition, clutch 49 is also formed with a plurality of axially facing forward teeth 54, which are adapted to engage the axially facing clutch teeth 55 on bevel gear 8.

Inner shaft 35 is formed with an axial opening or passage 56 and a drive assembly 57 is mounted for sliding axial movement within opening 56. Drive gear assembly 57 is rotatably connected to inner propeller shaft 35 through spline 58. The forward hub on drive gear assembly 57 will pilot shift spool 59 which is formed with a circumferential groove 60 that receives a crank 61 attached to the lower end of actuating rod 62, as shown in FIG. 6. Rod 62 extends upwardly through a suitable opening in gearcase 3 and is journaled for rotation relative to the gearcase.

The drive gear assembly 57 is provided with a gear 63 having external radially facing teeth 64 which are adapted to engage radially facing gear teeth 65 on the hub of bevel gear 8, when the slide is moved to the left, as shown in FIG. 6.

Drive gear assembly 57 is adapted to be moved longitudinally by rotation of rod 62. Rotation of rod 62 will correspondingly rotate crank 60 to thereby move drive gear assembly 57 axially relative to inner shaft 35 and, as previously noted, movement of drive gear assembly 57 to the left, as shown in FIG. 2, will bring the drive gear teeth 64 into engagement with the teeth 65 on bevel gear 8.

Axial movement of drive gear assembly 57 will also be transmitted to clutch 49. In this regard, a pin 66 is mounted within a radial hole in drive gear assembly 57 and extends outwardly through longitudinally elongated slots 67 in inner shaft 35. Each outer end of pin 66 is mounted between a pair of thrust washers 68 so that the pin can rotate relative to clutch 49. Washers 68 and pin 66 are held in position against an internal shoulder on clutch 49 by snap ring 69.

FIG. 6 shows the clutch 49 in a neutral position in which the clutch teeth 52 and 54 are out of engagement with the respective bevel gears 7 and 8.

To provide forward movement of the boat or watercraft, the actuating rod 62 is rotated in a direction to rotate crank 60 and move the drive gear assembly 57 to the left as shown in FIG. 6. Movement of the drive gear assembly 57 to the left will cause the teeth 64 to engage teeth 65 on bevel gear 8, to there rotate the inner propeller shaft 35. Axial movement of drive gear assembly 57 will also be transmitted through pin 66 to clutch 49 to cause engagement of clutch teeth 52 with teeth 53 of bevel gear 7. Rotation of the bevel gear 7 will then rotate clutch 49 and as the clutch is splined to outer shaft 17, the outer shaft, as well as the propeller 23 will rotate. Rotation of propeller 23 will be in the opposite direction from rotation of propeller 38.

To provide reverse movement for the boat, rod 62 is rotated in a direction to cause the drive gear assembly 57 to move to the right as viewed in FIG. 6. In this position, gear teeth 64 are out of engagement with bevel gear 8, so there is no rotation of inner propeller shaft 35 or propeller 38. However, movement of the drive gear assembly 57 to the right will act through pin 66 to move clutch 49 to a position where the forwardly facing clutch teeth 54 will engage the teeth 55 on bevel gear 8. The rotation of bevel gear 8 will thus be transmitted to clutch 49, and as clutch 49 is splined to outer propeller shaft 17, the propeller shaft 17 will rotate in accordance with rotation of bevel gear 8, and thus be driven in the opposite direction to move the boat in reverse.

With the drive mechanism of the invention, both propellers are operated in the forward mode while only the forward propeller 23 is operated in the reverse mode.

The drive mechanism of the invention provides a simplified construction reducing the number of components required for driving in forward and reverse positions. In addition, the drive mechanism is easier to assemble and disassemble than twin propeller drive mechanisms as used in the past.

As a further feature, the propulsion unit of the invention includes an improved water pick-up mechanism for supplying cooling water to the cooling system of the engine. Both sides of gearcase 3 are provided with a series of vertically spaced pick-up holes 72 which communicate with a generally curved or arcuate vertical passage 73 in the gearcase, as seen in FIG. 2. The upper end of passage 73 is connected to a generally annular passage 74 which communicates with the inlet opening of a conventional water pump 75 which is mounted on drive shaft 2 and is driven by the drive shaft. The outlet of pump 75 communicates with an outlet passage 76 which is connected to the cooling passages of the engine.

In accordance with the invention, a second series of water pick-up holes 77 are located in the forward end of torpedo 6, below the center line of the torpedo. As shown in FIG. 8, four pick-up holes 77 are provided, although the number can vary and each hole 77 communicates with the lower end of a vertical passage 78. The upper end of passage 78 is connected through a generally horizontal passage 79 with the annular passage 74, as illustrated in FIG. 2. With this construction, water is not only drawn to the pump 75 through the series of pick-up holes 72, but also through holes 77. At slow running speeds the water pick-up system provides greater pick-up area which aids in supplying water to the pump. Further, the engine can be moved somewhat upwardly relative to the water line before effecting the supply of water to the pump. In this regard, if the engine is moved upwardly relative to the transom so that the uppermost pick-up holes 72 are above the water line, there will still be sufficient water supplied to the pump through the remaining holes 72, as well as through the holes 77. Further, the combination of the holes 72 and 77 will ensure adequate water supply even though there may be clogging of certain holes by weeds.

As a further feature of the invention, a provision is made to discharge exhaust gas from the engine through the hub 22 of propeller 23 and then across the outer surface of hub 39 of propeller 38. As shown in FIGS. 2 and 8, a nut 82 is threaded within the rear end of torpedo section 6 and along with locking tab 83 serves to retain bearing carrier 10 within section 6. The rear portion of the gearcase 3 defines an exhaust chamber 84 into which exhaust gas from the exhaust manifold is supplied. A series of axial passages 85 connect chamber 84 with the annular area 86 located at the rear of bearing carrier 10. Hub 22 is formed with a series of longitudinal passages 87 which communicate with the area 86. With this construction the exhaust gas from chamber 84 will flow through passages 85 into the annular area 86 and then through the passages 87 in hub 22. The gas exiting the passages 87 will then flow across the outer surface of hub 39 of propeller 38. The flow of the exhaust gas through the hub of propeller 23 and across the hub 39 of the aft propeller is believed to increase the performance of the engine. A minor portion of the exhaust gas in annular area 86 can flow to the exterior through the annular gap 88 between the rear end of torpedo section 6 and the forward end of propeller hub 22.

As a further feature of the invention, a detent mechanism is employed to hold the clutch 49 and drive gear 57 in the neutral position. In this regard, a spring-loaded detent 89 is mounted in a radial hole in inner shaft 35 and is adapted to engage a circumferential groove 90 in drive gear 57. The engagement of detent 89 with groove 90 will hold the clutch 49 in a central or neutral position as well as maintaining the drive gear 57 out of engagement with teeth 65 on bevel gear 8.

We claim:

1. An improved twin propeller marine propulsion unit, comprising a housing, a drive shaft journaled for rotation in the housing, a first propeller shaft disposed within the housing and mounted for rotation relative to the housing, a first propeller secured to said first propeller shaft, a second propeller shaft disposed within the housing and mounted for rotation to the housing, said second propeller shaft disposed concentrically of said first propeller shaft, a second propeller secured to said second propeller shaft and disposed axially of the first propeller, a first bevel gear operably connected to the drive shaft, a second bevel gear operably connected to the drive shaft and disposed coaxially with said first bevel gear, said first bevel gear including a plurality of first axially facing bevel gear teeth, first engagement means mounted for axial movement relative to the first propeller shaft and rotatably fixed to said first propeller shaft, said first engagement means being movable between an engaged position and a disengaged position, said first engagement means including a plurality of axially facing clutch teeth disposed to engage said first bevel gear teeth when said first engagement means is moved to the engaged position, second engagement means mounted for axial movement relative to said second propeller shaft and rotatably fixed to said second propeller shaft, said second engagement means being movable between a disengaged position and an engaged position, said second bevel gear including a plurality of second radial bevel gear teeth, said second engagement means comprising a gear having radial gear teeth engaging said second radial bevel gear teeth when said second engagement means is in the engaged position, and actuating means for moving said first engagement means and said second engagement means in unison from the respective disengaged positions to the engaged positions.

2. The unit of claim 2, wherein said first engagement means comprises an annular clutch disposed concentrically outward of said first propeller shaft and said second propeller shaft, said actuating means comprising a slide mounted coaxially of said second propeller shaft and slidable relative to said second propeller shaft, said gear being mounted on said slide, and connecting means for connecting said slide to said clutch, said connecting means being mounted for free longitudinal movement relative to said second propeller shaft and being mounted for free rotational movement relative to said clutch.

3. The unit of claim 2 wherein said connecting means comprises a radial pin connected to said slide, said second propeller shaft having an elongated longitudinal slot to receive said pin, the outer end portion of said pin being connected to said clutch in a manner to prevent relative longitudinal movement between the clutch and the slide and to permit relative rotational movement between said clutch and said slide.

4. An improved twin propeller marine propulsion unit for a watercraft, comprising a housing, a vertical drive shaft journaled for rotation in the housing, a first bevel gear operably connected to said drive shaft and having a plurality of axially facing teeth, a second bevel gear mounted coaxially with said first bevel gear and operably connected to said drive shaft, said second bevel gear having a plurality of radial teeth, an outer propeller shaft mounted for rotation relative to the housing, a first propeller secured to a rear end of said outer propeller shaft, an inner propeller shaft disposed concentrically within the outer propeller shaft and mounted for rotation relative to the housing, a second propeller secured to a rear end of said second propeller shaft and disposed axially of said first propeller, an annular clutch disposed radially outward of said outer propeller shaft and having a plurality of clutch teeth facing said axial bevel gear teeth, said clutch being slidable in a first direction relative to said outer propeller shaft between a neutral position and a first engaged position and rotatably fixed to said outer propeller shaft, a slide mounted for sliding movement relative to said inner propeller shaft, a gear mounted on the slide and having a plurality of radial teeth disposed to engage the radial teeth on said second bevel gear, means for moving the slide axially of said inner propeller shaft in said a first direction to engage said gear teeth with said radial teeth on said second bevel gear and thereby drive said inner propeller shaft and said second propeller, and connecting means for connecting said slide and said clutch to thereby move said clutch in accordance with movement of said slide to said engaged position and effect engagement of said clutch teeth with the axial teeth on said first bevel gear to thereby drive the outer propeller shaft and said first propeller.

5. The unit of claim 4 wherein said connecting means comprises a radial pin having an inner end connected to said slide, said inner propeller shaft having an elongated longitudinal slot to receive said pin, the outer end of said pin being connected to said annular clutch in a manner to permit relative rotation of said pin relative to said clutch but to effect longitudinal movement of said clutch in accordance with longitudinal movement of said pin.

6. The unit of claim 5, and including detent means to hold the clutch in said neutral position.

7. The unit of claim 6, wherein said detent means comprises a circumferential groove in said slide, a detent mounted on an inner surface of said inner propeller shaft and disposed to engage said groove, and biasing means for urging said detent into said groove.

8. The unit of claim 4, wherein said clutch includes a plurality of second axially facing teeth facing toward said second bevel gear, said second bevel gear having a plurality of axially facing bevel gear teeth, movement of the clutch in an opposite direction from said first direction to a second engaged position causing engagement of the second axial teeth on said clutch with the axial teeth on said second bevel gear to thereby drive the outer propeller shaft in the opposite direction and provide reverse motion for the watercraft.

9. The unit of claim 8, wherein the radial gear teeth are out of engagement with the radial teeth on the second bevel gear when the clutch is in the second engaged position.

10. The unit of claim 4, wherein said connecting means is constructed and arranged to permit relative rotation between said slide and said clutch and to effect axial movement of the clutch in accordance with axial movement of the slide.

* * * * *

UNITED STATES PATENT AND TRADEMARK OFFICE

CERTIFICATE OF CORRECTION

PATENT NO. : 5,791,950

DATED : August 11, 1998

INVENTOR(S) : Robert B. Weronke et al

It is certified that error appears in the above-indentified patent and that said Letters Patent is hereby corrected as shown below:

In The Claims

Col. 6, line 64, CLAIM 2, Cancel "2" and substitute therefor ---1---

Col. 7, line 39, CLAIM 4, Cancel "a"

Signed and Sealed this

Eleventh Day of May, 1999

*Attest:*

*Attesting Officer*

Q. TODD DICKINSON

*Acting Commissioner of Patents and Trademarks*